US007540483B2

(12) United States Patent
Park

(10) Patent No.: US 7,540,483 B2
(45) Date of Patent: Jun. 2, 2009

(54) CUSTOMER ACCESS APPARATUS FOR MEDIA DISPENSER

(75) Inventor: Eung Min Park, Seoul (KR)

(73) Assignee: LG Electronics Inc., Seoul (KR)

( * ) Notice: Subject to any disclaimer, the term of this patent is extended or adjusted under 35 U.S.C. 154(b) by 474 days.

(21) Appl. No.: 11/322,644

(22) Filed: Jan. 3, 2006

(65) Prior Publication Data

US 2006/0151939 A1 Jul. 13, 2006

(30) Foreign Application Priority Data

Jan. 4, 2005 (KR) ..... 10-2005-0000630

(51) Int. Cl.
*B65H 5/22* (2006.01)

(52) U.S. Cl. ..... 271/3.14; 209/534; 221/175; 109/45; 109/47

(58) Field of Classification Search ..... 221/175, 221/177; 232/44; 109/16, 17, 66, 45, 47; 271/3.1, 3.14; 209/534
See application file for complete search history.

(56) References Cited

U.S. PATENT DOCUMENTS 4,423,826 A * 1/1984 Hirata et al. ..... 221/100
4,489,662 A * 12/1984 Masachika ..... 109/66
4,628,192 A * 12/1986 Suzuki ..... 235/1 R
4,726,474 A * 2/1988 Arikawa et al. ..... 209/534
5,016,546 A * 5/1991 Haueter ..... 109/45
6,334,610 B1 * 1/2002 Minamishin et al. ..... 271/3.04
7,225,911 B2 * 6/2007 Yokoi et al. ..... 194/205

* cited by examiner

*Primary Examiner*—Kaitlin S Joerger
(74) *Attorney, Agent, or Firm*—KED & Associates, LLP

(57) ABSTRACT

A customer access apparatus for an automatic media dispenser is provided. The customer access apparatus may include a pivotable supporting plate that supports an end of the media standing upright, and a stacker guide which is movably installed on the supporting plate. A push plate moves integrally with the stacker guide and relative to the stacker guide, and a driving unit recovers media which have been compressed and conveyed by the stacker guide and the push plate. Upper ends of the stacker guide and plate are selectively located at a position where the media are raised toward an inlet to which a customer has access, by means of a rotation of the supporting plate, such that a process of depositing and withdrawing the media can be performed. A contact point between the customer and the customer access apparatus may be located outside of the customer access apparatus such that the operation of depositing and withdrawing the media can be performed more accurately and easily. In particular, the media can be accurately arranged when the customer deposits the media, and the media to be recovered or deposited can be separated out one by one and then conveyed, arraigned and stored. Recovered media can be used again as it is stored in the automatic media dispenser.

14 Claims, 7 Drawing Sheets

[Fig.1]
Related Art
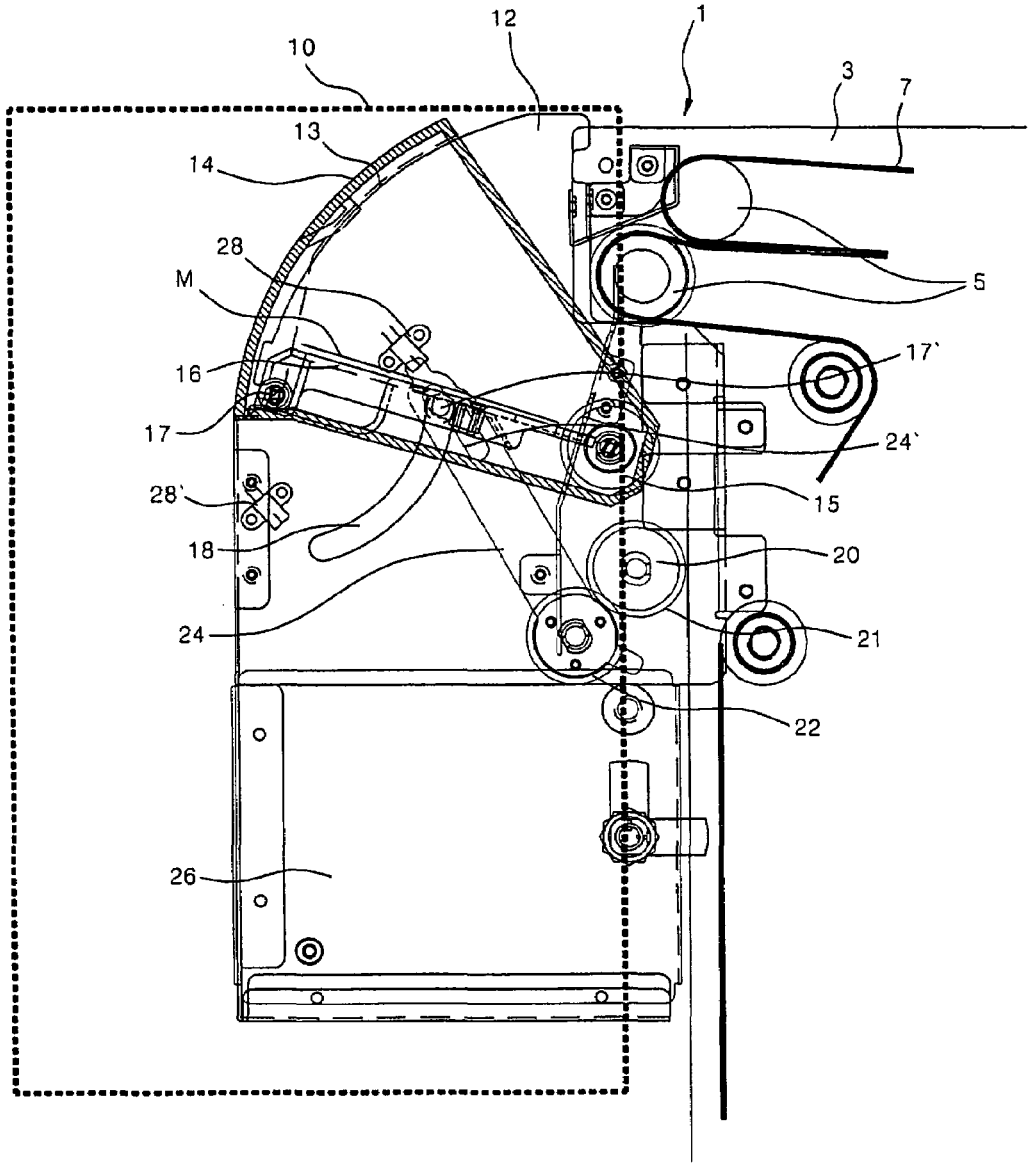

【Fig.2】
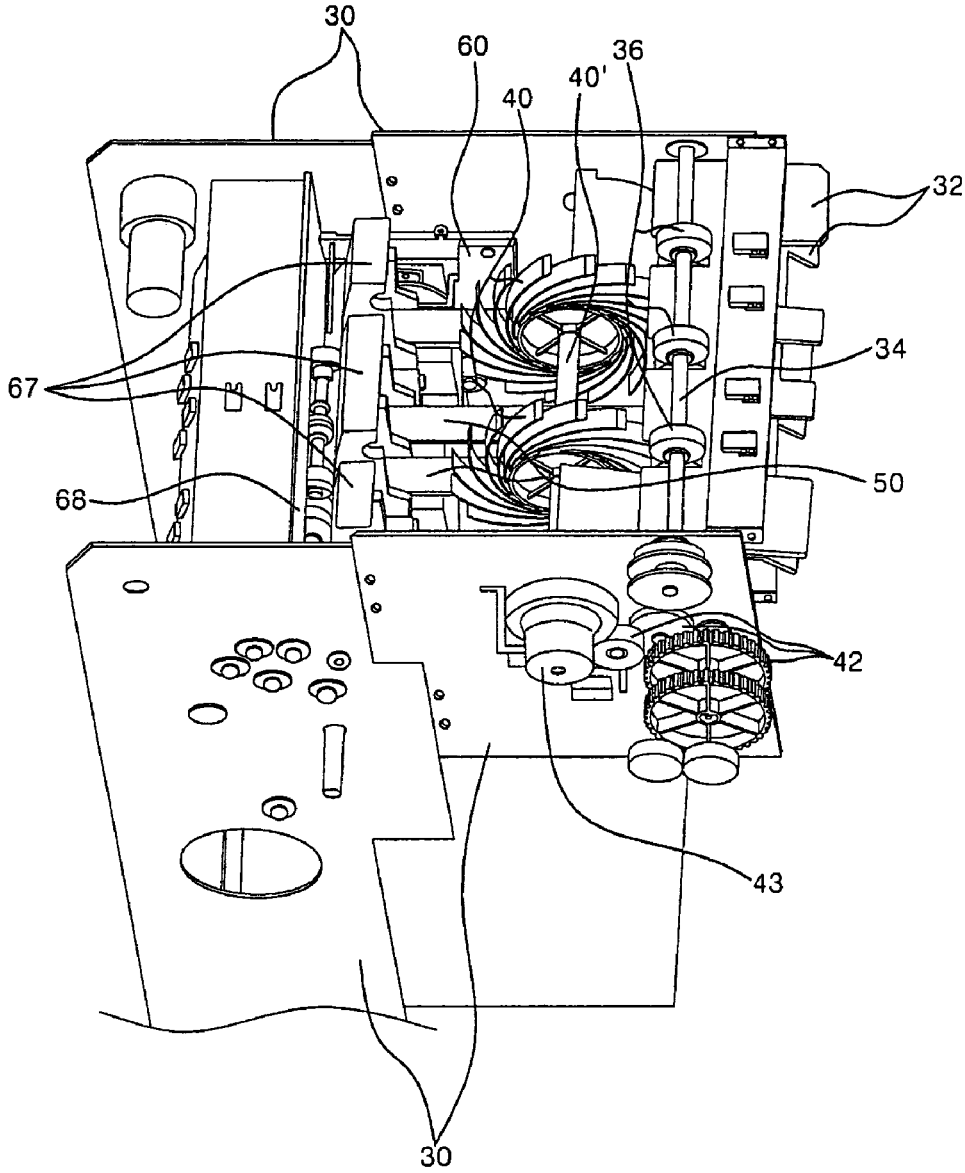

【Fig.3】
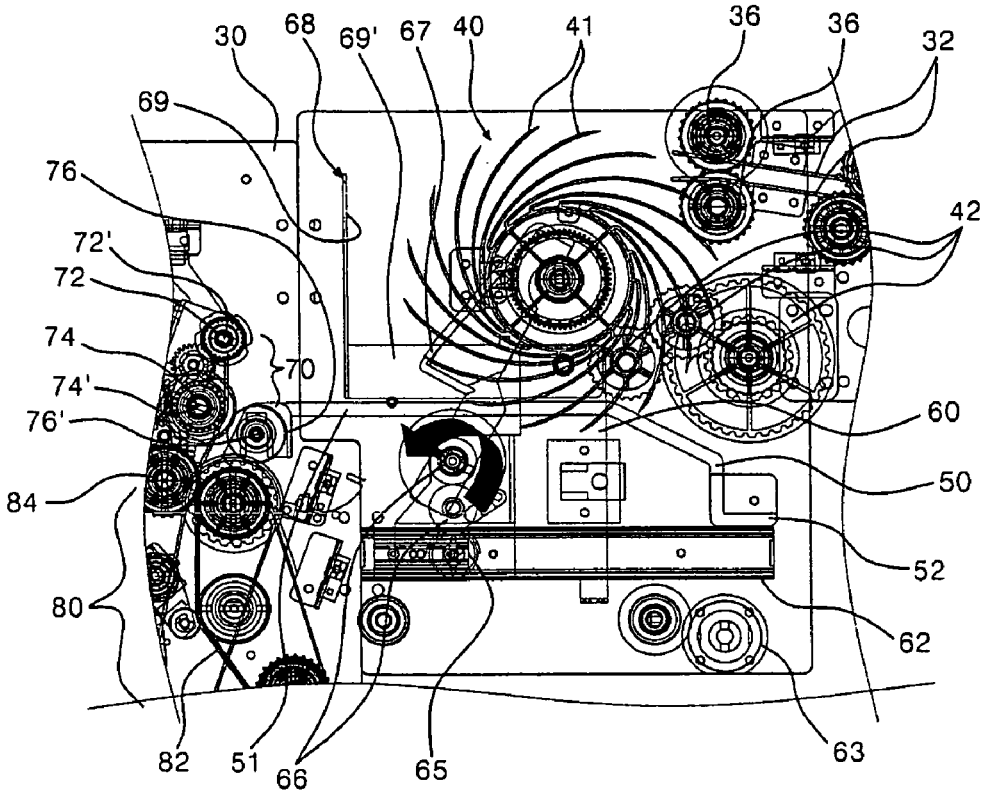

【Fig.4a】
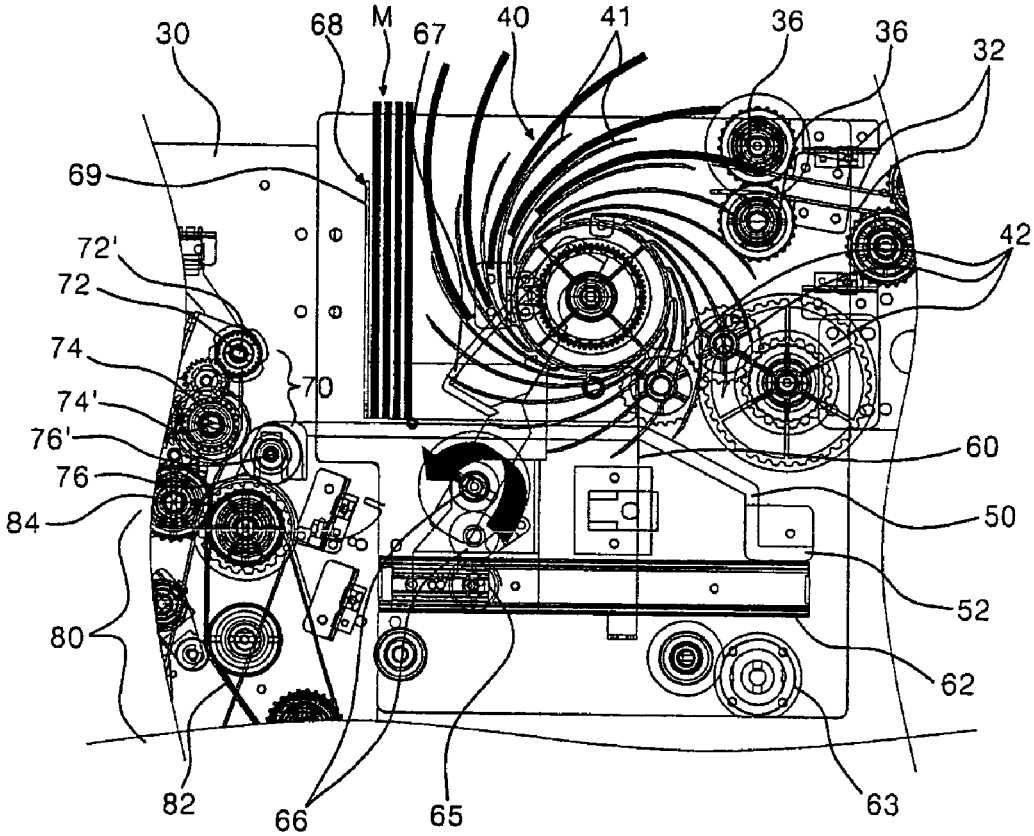

【Fig.4b】
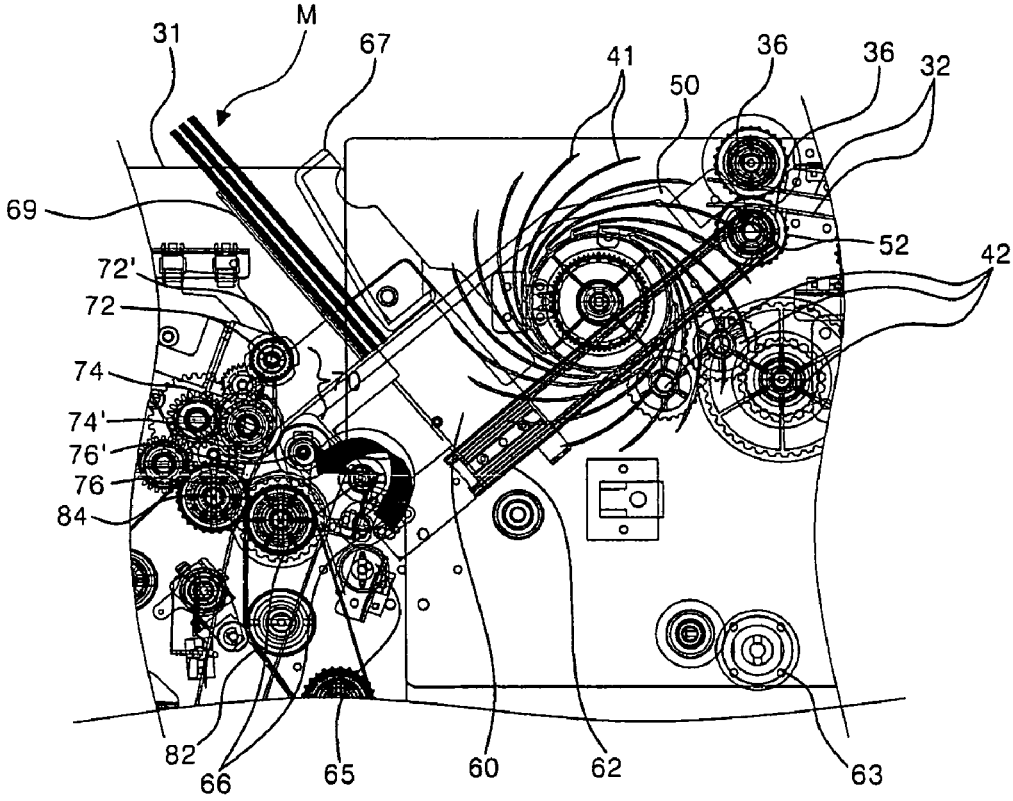

【Fig.4c】
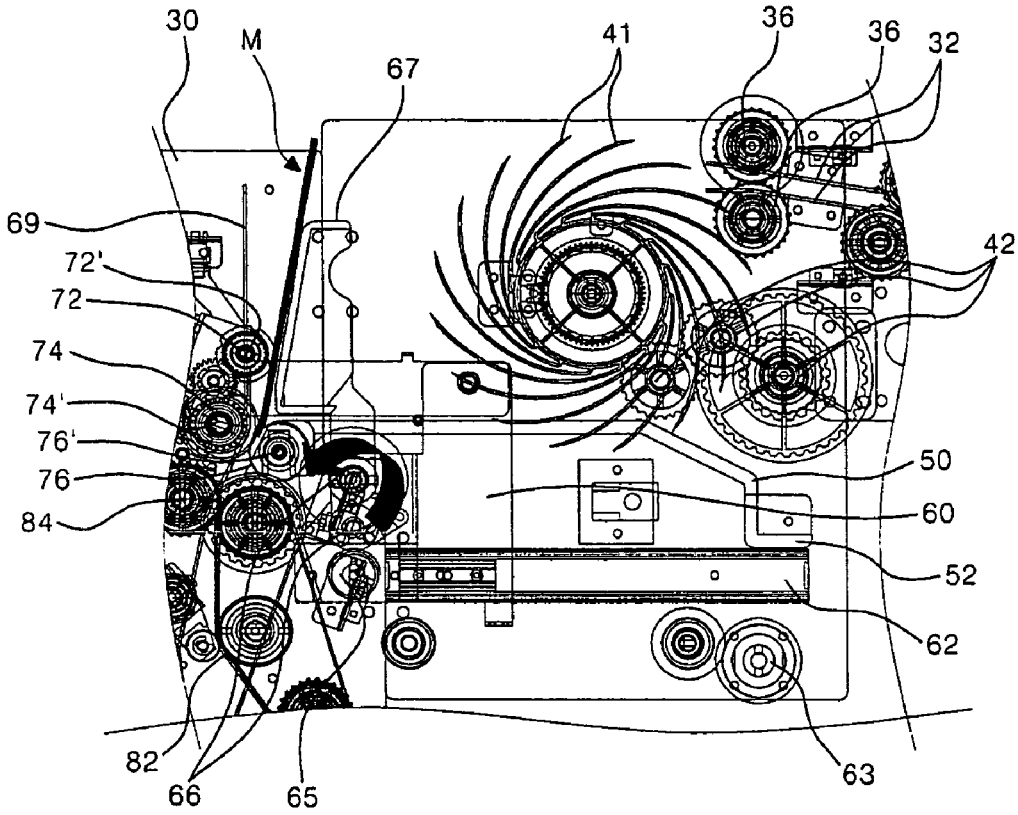

【Fig.4d】
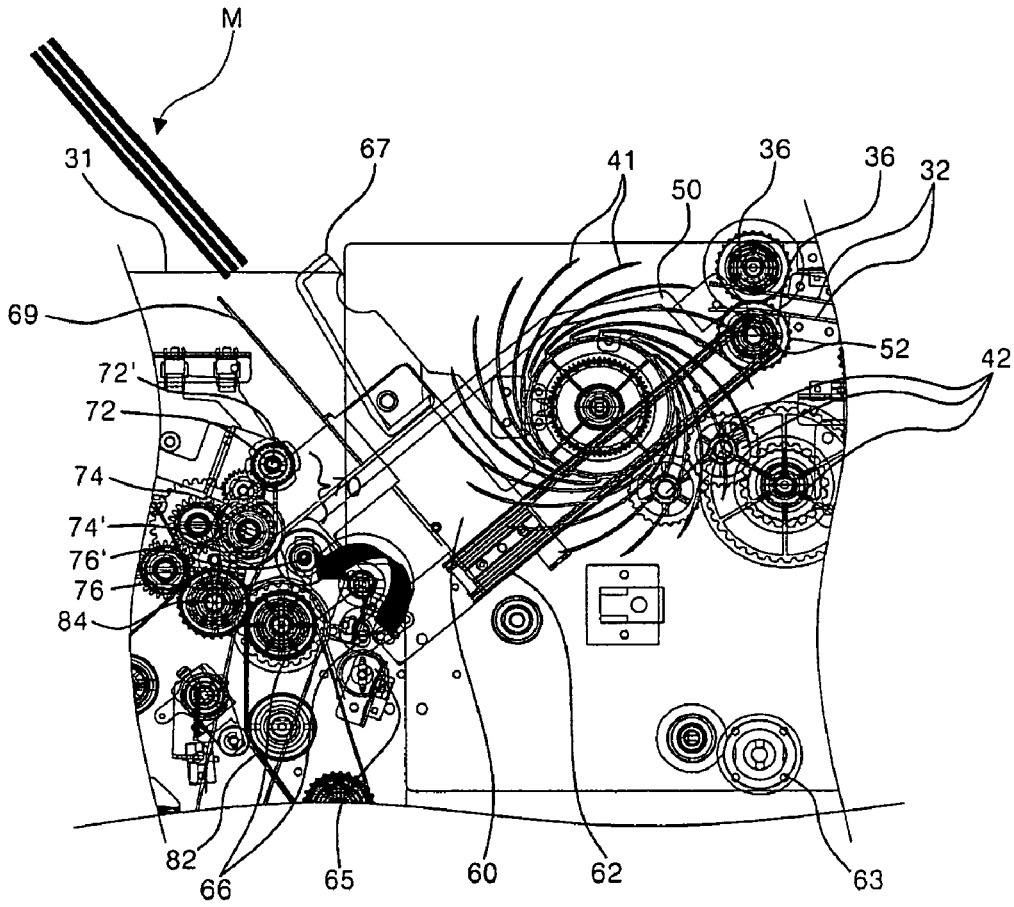

CUSTOMER ACCESS APPARATUS FOR MEDIA DISPENSER

BACKGROUND OF THE INVENTION

1. Field of the Invention

The present invention relates to an automatic media dispenser, and more particularly, to a customer access apparatus for an automatic media dispenser to which the customer can have access for putting in and taking out the media.

2. Description of the Prior Art

A term of "media" used herein refers to sheets, for example, bills, checks, tickets, certificates and the like which have a thickness remarkably smaller than a width or length.

FIG. 1 is a side view showing the configuration of a customer access apparatus for an automatic media dispenser according to the prior art. Referring to this figure, the automatic media dispenser 1 comprises a media storage box (not shown), a feed module (not shown) for picking up media M from the media storage box and conveying the taken-out media, a delivery module 3 for conveying the media M that have passed through the feed module, and a customer access apparatus 10 (indicated by dotted lines) for collecting the media M that have passed through the delivery module 3 and providing the collected media to the customer. The delivery module 3, the feed module and the like utilize a conveying belt 5, a belt 7 and the like to convey the media M.

Here, the configuration of the customer access apparatus 10 will be described as follows. A frame 12 defines an external appearance of the customer access apparatus 10. A predetermined space is defined in the customer access apparatus 10 by means of the frame 12. A door 14 is installed on the frame 12 and serves to selectively cover the space in the customer access apparatus 10. That is, the door 14 selectively closes an inlet 13 formed on a front surface of the customer access apparatus 10. The door 14 is driven by means of a door motor 15 installed at the center of rotation thereof. The door motor 15 is operated in a forward or reverse direction to open or close the door 14.

A base tray 16 is installed within the space that is opened and closed by the door 14. The base tray 16 is generally shaped as a rectangular plate, and the base tray 16 are installed to the frame 12 to be pivoted on a hinge shaft 17. Driving protrusions 17' are formed at intermediate portions on both sides of the base tray 16. The protrusions 17' are guided along guide channels 18 formed on the frame 12.

A tray motor 20 for driving the base tray 16 is provided on the frame 12. A driving gear 21 is provided on a rotational shaft of the tray motor 20, and a driven gear 22 is provided to be meshed with the driving gear 21. A driving link 24 is connected to the driven gear 22. The driving link 24 is pivoted on the center of rotation of the driven gear 22. A cooperation slot 24' in which the driving protrusion 17' of the base tray 16 is inserted and guided is formed on a free end of the driving link 24. For reference, the mechanism for driving the base tray 16 is provided on each side of the base tray 16.

A recovery box 26 for collecting the media M to be returned is provided at a lower portion of the customer access apparatus 10. The media M that have been provided to but not taken by the customer are collected and stored in the recovery box 26.

Reference numeral 28 denotes a sensor for sensing an initial position of the base tray 16 and a position to which the base tray 16 is returned after the media M in the base tray are emptied out into the recovery box 26, and reference numeral 28' denotes a sensor for sensing a state where the base tray 16 has been completely rotated for emptying out the medium M received therein.

The media dispenser according to the prior art so configured is operated as follow.

The media M that have been delivered from the media storage box through the feed module and the delivery module 3 are stacked on the base tray 16. When a desired amount of the media M is stacked on the base tray 16, the door motor 15 is driven to open the door 14. If the door 14 is rotated and moved upward, the inlet 13 is opened. Thus, the customer can have access to the media M stacked on the base tray 16.

However, if the customer does not take the media M stacked on the base tray 16 in a specific time, the door 14 is closed and the media M stacked on the base tray 16 are sent into the recovery box 26. That is, after the door 14 has been closed, the tray motor 20 is driven to rotate the driving link 24 counterclockwise (in FIG. 1) so that the base tray 16 can be pivoted on the hinge shaft 17. At this time, as the driving link 24 is operated, the driving protrusions 17' are moved along both the slot 24' and the guide channel 18 to cause the base tray 16 to be pivoted on the hinge shaft.

The base tray 16 continues to pivot until the sensor 28' senses the rotation of the base tray 16, and the media M fall down into the recovery box 26 as the base tray 16 is rotated. Once the sensor 28' senses the rotation of the base tray 16, the tray motor 20 is operated in an opposite direction. As the tray motor 20 is operated in the opposite direction, the base tray 16 is pivoted counterclockwise on the hinge shaft 17 until the sensor 28 senses the rotation of the base tray. In this state, the media M conveyed from the feed module and the delivery module 3 can be received in the base tray 16.

However, the aforementioned prior art has the following problems.

In the related art customer access apparatus 10, the customer can take the media M received therein if the door 14 installed at the inlet 13 should be opened. That is, there is an inconvenience in that the customer must put his/her hand into the customer access apparatus 10 to take out the media M. However, some customers may be reluctant to put his/her hand into the customer access apparatus 10.

Further, since there are the media M in the customer access apparatus 10, the customer should carefully examine the interior of the customer access apparatus 10 through the inlet 13 to prevent some media from remaining in the customer access apparatus 10.

Furthermore, since the related art customer access apparatus 10 is not used in depositing the media M, the apparatus cannot provide the customer with a variety of functions. Although the related art customer access apparatus 10 has the structure that can deposit the media M, the customer must put the media M deep into the customer access apparatus through the inlet 13 to deposit the media M. Therefore, due to a variety of conditions such as the physical constitution of the customer, the media M received in the customer access apparatus 10 cannot be properly arranged. In such a case, the media M may be caught to a conveying path in the process of receiving the media M, and thus, the apparatus can be out of order.

Meanwhile, in the related art customer access apparatus, the media M that have not yet taken by the customer fall down into the recovery box 26 at the same time, and thus, the media M cannot be provided to the customer. That is, to use again the collected media M in the automatic media dispenser, the clerk should take out the media M from the automatic media dispenser, confirm the number of the media and puts the media into a media cassette.

SUMMARY OF THE INVENTION

Accordingly, the present invention is conceived to solve the aforementioned problems in the prior art. An object of the present invention is to provide an apparatus for discharging/receiving media from which the media are raised such that the customer can take the media.

Another object of the present invention is to provide an apparatus for discharging/receiving media by which the customer can deposit the media without putting the media into the apparatus.

A further object of the present invention is to provide an apparatus for discharging/receiving media wherein the operation for depositing, withdrawing and waiting to recover media can be performed in a single space of the apparatus.

A still further object of the present invention is to provide an apparatus for discharging/receiving media by which the media to be recovered or deposited are conveyed one by one such that the conveyed media can be arranged, stored and used again.

According to an aspect of the present invention for achieving the objects, there is provided a customer access apparatus for an automatic media dispenser, comprising: a rotatable supporting plate for supporting an end of the media; a stacker guide installed on the supporting plate for allowing one surface of the medium supported on the supporting plate to be placed thereon; and a push plate for compressing the media against the stacker guide.

Preferably, upper ends of the stacker guide and the push plate are selectively located at a position facing an inlet to which the customer has access, by means of a rotation of the supporting plate.

More preferably, the stacker guide and the push plate are movable.

More preferably, the stacker guide and the push plate are moved integrally with each other.

More preferably, further comprising a conveying plate installed movably on the supporting plate for causing the stacker guide and the push plate to be moving integrally with each other.

More preferably, the supporting plate is installed on a frame of which both ends are rotatably supported on frame plates.

More preferably, the push plate is rotatable.

More preferably, stacking wheels and the push plate convey the media to the supporting plate in response to a customer's request, and the stacking wheels include a plurality of conveying vanes formed spirally on an outer circumference surface thereof and rotated with each medium inserted between the adjacent conveying vanes.

More preferably, further comprising a driving unit for conveying one by one the media to be recovered or deposited, wherein the media are conveyed toward the driving unit in a state where the media are compressed between the stacker guide and the push plate.

According to other aspect of the present invention for achieving the objects, there is provided a customer access apparatus for an automatic media dispenser, comprising: a pivotable supporting plate for supporting an end of the media standing upright; a stacker guide movably installed on the supporting plate for allowing one surface of the medium supported on the supporting plate to be placed thereon; a push plate moving integrally with the stacker guide and being pivoted to be close to or far away from the stacker guide; and a driving unit for recovering the media compressed and conveyed by the stacker guide and the push plate, wherein upper ends of the stacker guide and the push plate are selectively located at a position where the media are raised toward an inlet to which the customer has access, by means of a rotation of the supporting plate, thereby performing a process of depositing and withdrawing the media.

Preferably, the stacker guide and the push plate are installed on a conveying plate installed movably on the supporting plate, and the push plate is rotated by a driving source installed on the conveying plate.

More preferably, the supporting plate is installed on a frame of which both ends are rotatably supported on frame plates, and a guide rail for guiding the conveying plate and a driving source for moving the conveying plate are installed on the frame.

More preferably, stacking wheels and the push plate convey the media to the supporting plate in response to a customer's request, and the stacking wheels include a plurality of conveying vanes formed spirally on an outer circumference surface thereof and rotated with each medium inserted between the adjacent conveying vanes.

More preferably, further comprising a driving unit for conveying one by one the media to be recovered or deposited, wherein the media are conveyed toward the driving unit in a state where the media are compressed between the stacker guide and the push plate.

According to the present invention so configured, there is an advantage in that a contact point between the customer and the customer access apparatus is located outside of the customer access apparatus such that the operation of discharging and depositing the media can be performed more accurately and easily. In particular, since the media can be accurately arranged when the customer deposits the media, the occurrence of malfunction of the apparatus can be minimized. Further, since the media to be recovered or deposited can be separated out one by one, and then conveyed, arranged and stored, the media can be used again as it is in the automatic media dispenser without the clerk's confirmation.

BRIEF DESCRIPTION OF THE DRAWINGS

The above and other objects, features and advantages of the present invention will become apparent from the following description of a preferred embodiment given in conjunction with the accompanying drawings, in which:

FIG. 1 is a side view showing the configuration of a customer access apparatus for an automatic media dispenser according to the prior art;

FIG. 2 is a schematic perspective view showing the configuration of an automatic media dispenser to which an apparatus for discharging/receiving media according to a preferred embodiment of the present invention is employed;

FIG. 3 is a side view showing the configuration of the automatic media dispenser to which the customer access apparatus according to the embodiment of the present invention is employed; and FIGS. 4*a* to 4*d* are views sequentially illustrating the operation of recovering the media in the customer access apparatus according to the embodiment of the present invention.

DESCRIPTION OF THE PREFERRED EMBODIMENTS

Hereinafter, a preferred embodiment of a customer access apparatus for an automatic media dispenser according to the present invention will be described in detail with reference to the accompanying drawings.

FIG. 2 is a schematic perspective view showing the configuration of an automatic media dispenser to which an apparatus for discharging/receiving media according to the preferred embodiment of the present invention is employed, and FIG. 3 is a side view showing the configuration of the automatic media dispenser according to the present invention.

Referring to these figures, frame plates 30 are disposed opposite to each other at a certain interval. The frame plates 30 define both sides of the customer access apparatus, and each of frame plates may consist of a plurality of unit plates. Various kinds of components constituting the customer access apparatus are installed within a space defined between the frame plates 30 and on the frame plates 30. In general, the customer access apparatus of which external appearance is defined by the frame plates 30 is installed within a separate cabinet defining an external appearance of the automatic media dispenser, and a part of the customer access apparatus is exposed to the outside. The frame plates 30 may define both sides of the delivery module and the like in addition to the customer access apparatus.

A pair of guide plates 32 for guiding the media M conveyed from the delivery module are provided between the frame plates 30. The guide plates 32 are disposed opposite to each other at a certain interval such that the media can be guided between the guide plates. A plurality of pairs of eject rollers 36 are installed at rear ends of the guide plates 32 to convey the media that have passed through the guide plates 32. That is, the plurality of eject rollers 36 are installed on an eject shaft 34, both ends of which are supported on the frame plates 30, respectively.

A stacking wheel 40 is provided between the frame plates 30 to convey the media M that have passed through the eject rollers 36 and to stack the conveyed media as many in number as the customer wants. A plurality of conveying vanes 41 are formed spirally on an outer circumferential surface of the stacking wheel 40 at regular intervals. The media M are placed one by one between two adjacent conveying vanes 41 and then conveyed.

A plurality of stacking wheels 40 are provided at regular intervals on a wheel shaft 40', both ends of which are supported on the frame plates 30. In this embodiment, two stacking wheels 40 are used. The number of the stacking wheels 40 to be used varies according to the width of the media M. The stacking wheels 40 are rotated by means of power transmitted from the delivery module. That is, the stacking wheels 40 are driven by power transmitted through a gear train 42. Of course, the stacking wheels 40 can receive the power from a separate driving source. A clutch 43 may be installed on a path along which the power needed to drive the stacking wheels 40 is transmitted, so that the rotating speed of the stacking wheels 40 can be controlled.

A supporting plate 50 is installed below the stacking wheels 40 between the frame plates 30. The supporting plate 50 is generally composed of a plurality of supporting portions 51 and a connecting portion 52. The media M stands upright on the supporting portions 51. Predetermined gaps are formed between the adjacent supporting portions 51 to prevent the supporting portion from interfering with the stacking wheels 40. That is, the plurality of plate-shaped supporting portions 51 are installed to extend between the stacking wheels 40. Ends of the supporting portion 51 are connected to one another by means of the connecting portion 52 at a position below the gear train 42.

The supporting plate 50 is installed in such a manner that one end of the supporting plate 50 is moved up and down with respect to the other end thereof. When the customer takes the accumulated media M from or puts new media into the customer access apparatus, the supporting plate 50 is pivoted and then inclined upward at a certain angle with respect a horizontal state. It is preferred that the center of rotation of the supporting plate 50 coincides with the center of rotation of a contra roller 76 to be described later. The power needed to rotate the supporting plate is transmitted to the contra roller from a separate driving source. Here, the supporting plate 50 is installed on a separate frame (not shown), and the supporting plate 50 is rotated as the frame is rotated about the center of rotation of the contra roller 76.

A conveying plate 60 is installed on the frame (not shown) to be movable with respect to the supporting plate 50. That is, a guide rail 62 is installed on the frame to which the supporting plate 50 is rotatably installed, so that the conveying plate 60 can be moved along the guide rail 62. The conveying plate 60 can be moved along the guide rail 62 using a driving force received through a belt from a driving motor 63 installed on the frame.

A push motor 65 is installed on the conveying plate 60. A driving force from the push motor 65 is transmitted through a gear train 66 to a push plate 67 which in turn is installed on the conveying plate 60 to be rotatable at a predetermined angle by means of the driving force from the push motor 65. The push plate 67 is also formed with cutout portions to prevent the push plate 67 from interfering with the stacking wheels 40 and the supporting plate 50. The push plate 67 is placed between the stacking wheels 40 such that it can separate out the media one by one, each of which is placed between the adjacent conveying vanes 41 of the stacking wheels 40 and conveyed onto the supporting plate 50, and guide the media toward the supporting plate 50.

Further, the push plate 67 serves to bring the media into close contact with a stacker guide 68, which will be described later, so as to provide the customer with the media or bring the media to be recovered into close contact with a pickup roller 72 which will be described later.

The stacker guide 68 is installed on the conveying plate 60 to be adjacent to the push plate 67. The stacker guide 68 is moved integrally with the conveying plate 60 and is formed to stand upright with respect to the supporting plate 50. A portion of the stacker guide 68 corresponding to the pickup roller 72 is cut out to prevent the stacker guide from interfering with the pickup roller 72. Further, the stacker guide 68 includes a supporting portion 69 which faces the push plate 67, and a connecting portion 69' which extends vertically from both sides of the supporting portion 69 and is connected to the conveying plate 60.

Furthermore, a driving unit 70 for recovering the media is provided at a position corresponding to an end of the supporting plate 50. The driving unit 70 separates out the media compressed between the push plates 67 and the stacker guide 68 and conveys the media one by one.

To this end, the pickup roller 72 is provided between the frame plates 30. A plurality of the pickup rollers 72 are provided on a pickup roller shaft 72' of which both ends are supported on the frame plates 30, respectively. The pickup rollers 72 are driven by a separate driving source and separate out the media between the push plate 67 and the stacker guide 68.

A feed roller 74 and the contra roller 76 are provided on a feed roller shaft 74' and a contra roller shaft 76', respectively, downstream of the pickup roller 72. Both ends of each of the feed roller 74 and the contra roller 76 are supported on the frame plates 30, respectively. The feed roller 74 is rotated in the same direction as the pickup roller 72 to convey the media, while the contra roller 76 is rotated in the opposite direction to the feed roller 74 or stopped to prevent several sheets of media from being conveyed simultaneously.

Next, a conveying unit 80 for conveying the media to be recovered is provided downstream of the feed roller 74 and the contra roller 76. The conveying unit 80 conveys the media to a desired position using a belt 82 and a conveying roller 84.

Hereinafter, the operation of the customer access apparatus the automatic media dispenser according to the present invention so configured will be described in detail.

The operation of the automatic media dispenser according the present invention will be described in detail with reference to FIG. 4. First, it is shown in FIG. 4*a* that the media M are accumulated on the supporting plate 50 by means of the stacking wheels 40. If the customer requests a predetermined amount of media M, the media M received in a media cassette are separated out and then conveyed. Finally, the conveyed media M are conveyed to the stacking wheels 40 through the delivery module.

At this time, the conveying plate 60 has been moved on the frame relatively toward the stacking wheels 40 along the guide rail 62, and thus, the stacker guide 68 is also positioned to be adjacent to the stacking wheels 40. The push plate 67 is inclined toward a direction in which the conveying vanes 41 of the stacking wheels 40 extend. In fact, a plurality of the push plates 67 are installed between and at outer sides of the stacking wheels 40 so as not to interfere with the stacking wheels 40. The push plate 67 is rotated by means of the operation of the push motor 65 at a certain angle with respect to the conveying plate 60, so that the push plate 67 is inclined between the stacking wheels 40.

Here, the media M pass between the guide plates 32 and are then discharged by means of the eject rollers 36. The media M discharged from the eject rollers 36 are inserted one by one between the conveying vanes 41 of the stacking wheels 40. The media M inserted between the conveying vanes 41 of the stacking wheels 40 are rotated as the stacking wheels 40 are rotated.

As the stacking wheels 40 are rotated, the media M inserted between the conveying vanes 41 are guided toward upper ends of the push plates 67 positioned between and at the outer sides of the stacking wheels 40 and then separated from the stacking wheels 40. The media M, which have been guided to the push plates 67 and separated from the stacking wheels 40, are guided toward the stacker guide 68 and then stand upright on the supporting portion 51 of the supporting plate 50. This operation will be repeatedly made such that the media M in number as many as the customer wants are placed on the supporting plate 50.

Once the desired amount of media M is accumulated, the push plates 67 are rotated by means of the operation of the push motor 65. The push plates 67 are rotated counterclockwise as viewed from FIG. 4*a*, and thus, the media M are compressed between the push plates 67 and the stacker guide 68.

In such a state, the support plate 50 is pivoted on the center of rotation of the contra roller 76 by means of a separate driving source. In this embodiment, the supporting plate 50 is rotated counterclockwise. Once the frame to which the supporting plate 50 is installed is pivoted on the center of rotation of the contra roller 76, the stacker guide 68 and the push plates 67 that are installed on the conveying plate 60 moving along the guide rail 62 installed on the frame are rotated together.

As the supporting plate 50 is rotated, the media M compressed between the stacker guide 68 and the push plates 67 are conveyed to a position where the customer can take the media, as shown in FIG. 4*b*. That is, the media M are raised up to a predetermined height. Therefore, the customer can easily take and accept the media M. Here, it can be seen from the figure that the media M protrude above an upper end of the frame plate 30. Accordingly, if a member defining the external appearance of the automatic media dispenser is installed at a position corresponding to the upper end of the frame plate 30, the media M can protrude out of the customer access apparatus.

Next, after the customer has taken the media M, the supporting plate 50 is rotated and returned to an original position. As such, if the push plates 67 is inclined and placed between the stacking wheels 40 as shown in FIG. 4*a*, the customer access apparatus is in a standby state to await the customer's request.

If the customer has not yet taken the media M, the media M should be recovered. To this end, the supporting plate 50 is returned to its original state. That is, the supporting plate 50 is pivoted clockwise on the center of rotation of the contra roller 76.

Further, the driving force from the driving motor 63 is transmitted to the conveying plate 60, which in turn is moved on the frame along the guide rail 62. Since the stacker guide 68 and the push plates 67 are installed on the conveying plate 60, they are moved together with the conveying plate 60. At this time, the media M compressed by the stacker guide 68 and the push plates 67 are moved toward the pickup roller 72 together with the stacker guide 68 and the push plates 67 as the conveying plate 60 is moved as described above. In such a case, the conveying plate 60 continues to move until the media M are brought into close contact with the pickup roller 72. The above state is shown in FIG. 4*c*.

In such a state, the pickup roller 72 is operated to separate out the media M one by one between the stacker guide 68 and the push plate 67. Then, the media M pass between the feed roller 74 and the contra roller 76. At this time, since the contra roller 76 is stopped or rotated in a direction opposite to the rotating direction of the feed roller 74 such that two sheets of media cannot be conveyed at one time.

The media M, which have passed between the feed roller 74 and the contra roller 76, are guided along the conveying unit 80 and conveyed to a unit in which the media M are stored. At this time, the storage unit in which the media M are stored may be a media cassette. Therefore, the recovered media M can be taken from the media cassette and then provided to the customer.

In the meantime, FIG. 4*d* shows a process of receiving the media that the customer wants to deposit. If the customer inputs his/her intention to deposit the media, the frame on which the supporting plate 50 is installed is rotated about the center of rotation of the contra roller 76. Upper ends of the stacker guide 68 and the push plates 67 are raised toward the inlet of the customer access apparatus, as the supporting plate 50 is rotated as described above. At this time, the upper ends of the push plates 67 are spaced apart from the stacker guide 68 at a predetermined angle. This condition can be adjusted by the operation of the push motor 65.

In such a state, the customer can merely insert the media M between the stacker guide 68 and the push plates 67. If it is confirmed that the media M have been already inserted into the customer access apparatus, the push plates 67 are rotated toward the stacker guide 68 by means of the push motor 65, and thus, it causes the media M to be compressed against the stacker guide 68. Then, after the supporting plate 50 is rotated in an opposite direction, the same process as when the media M is recovered is performed.

That is, the customer access apparatus is in such a state as shown in FIG. 4*c*, and then, the media M are conveyed one by one by means of the driving unit 70 and the conveying unit 80, and arranged and stored in a specific position.

As described in detail above, the customer access apparatus the automatic media dispenser according to the present invention has the following advantages.

First, the present invention is configured in such a manner that the media can be guided and accumulated in order by the stacking wheels and the push plates, and then raised out of the customer access apparatus to allow the customer to take out the media. Accordingly, there is an advantage in that the customer can take out the media more securely and easily.

Further, when the media are put into the automatic media dispenser, the media can be placed between the stacker guide and the push plates in a state where the media are raised out of the customer access apparatus. Accordingly, since the customer can securely arrange and place the media in the customer access apparatus, there is another advantage in that the media can be deposited more securely and easily.

Furthermore, the operation for depositing, withdrawing and recovering the media is performed in a space where the stacker guide and the push plates are provided. Accordingly, the customer access apparatus does not occupy a relatively larger space and can also perform a variety of functions.

In addition, according to the present invention, the media can be conveyed one by one when the media are recovered and deposited. Accordingly, the customer access apparatus according to the present invention can count correctly and then store the media that have been already recovered or deposited. Therefore, if the counted media can be conveyed into the media cassette, the media in the media cassette can be used as the media to be provided to the customer upon the request of the customer.

Although the present invention has been described in connection with the preferred embodiment, it will be apparent to those skilled in the art that various changes and modifications can be made thereto without departing from the scope and spirit of the present invention. Therefore, the true scope of the present invention is defined by the appended claims, and the changes and modifications should be constructed as falling within the scope of the present invention.

What is claimed is:

1. A customer access apparatus for an automatic media dispenser, the apparatus comprising:

a rotatable supporting plate that supports an end of media to be processed by the apparatus;

a stacker guide installed on the supporting plate, wherein the stacker guide receives a surface of the media supported on the supporting plate;

a push plate that compresses the media against the stacker guide; and a driver that receives deposited or recovered media that is compressed against the stacker guide, and conveys the media individually.

2. The apparatus as claimed in claim 1, wherein upper ends of the stacker guide and the push plate are selectively located at a position facing a customer inlet in response to a rotation of the supporting plate.

3. The apparatus as claimed in claim 1, wherein the stacker guide and the push plate are movable.

4. The apparatus as claimed in claim 3, wherein the stacker guide and the push plate are moved integrally with each other.

5. The apparatus as claimed in claim 4, further comprising a conveying plate movably installed on the supporting plate, wherein the conveying plate moves the stacker guide and the push plate integrally with each other.

6. The apparatus as claimed in claim 1, wherein the supporting plate is installed on a frame, wherein each of two opposite ends of the frame are rotatably supported on respective frame plates.

7. The apparatus as claimed in claim 1, wherein the push plate is rotatable.

8. The apparatus as claimed in claim 1, wherein stacking wheels and the push plate convey the media to the supporting plate in response to a customer request, and wherein the stacking wheels each include a plurality of conveying vanes that extend spirally from a central hub thereof, wherein the stacking wheels rotate with each medium inserted between adjacent conveying vanes.

9. The apparatus as claimed in claim 5, wherein the conveying plate is configured to move toward the driver until the media are brought into close contact with the driver when the media is not withdrawn from the apparatus within a predetermined amount of time.

10. A customer access apparatus for an automatic media dispenser, the apparatus comprising:

a pivotable supporting plate that supports, in an upright position, an end of media to be processed by the apparatus;

a stacker guide movably installed on the supporting plate, wherein the stacker guide receives a surface of the media supported on the supporting plate;

a push plate that moves integrally with the stacker guide, and that pivots relative to the stacker guide; and a driver that conveys, one by one, media to be recovered or deposited, and that recovers the media compressed and conveyed by the stacker guide and the push plate, wherein upper ends of the stacker guide and the push plate are selectively located at a position where the media are raised toward a customer access inlet in response to a rotation of the supporting plate so as to provide for deposit and withdrawal of the media.

11. The apparatus as claimed in claim 10, wherein the stacker guide and the push plate are installed on a conveying plate that is movably installed on the supporting plate, and wherein the push plate is rotated by a driving source installed on the conveying plate.

12. The apparatus as claimed in claim 10, wherein the supporting plate is installed on a frame, wherein each of two opposite ends of the frame are rotatably supported on respective frame plates, and wherein a guide rail that guides movement of the conveying plate and a driving source that moves the conveying plate are installed on the frame.

13. The apparatus as claimed in claim 10, wherein stacking wheels and the push plate convey the media to the supporting plate in response to a customer request, and wherein the stacking wheels include a plurality of conveying vanes that extend spirally from a central hub thereof, and wherein the stacking wheels rotate with each medium inserted between adjacent conveying vanes.

14. The apparatus as claimed in claim 12, wherein the conveying plate is configured to move toward the driver until the media are brought into close contact with the driver when the media is not withdrawn from the apparatus within a predetermined amount of time.

* * * * *

UNITED STATES PATENT AND TRADEMARK OFFICE

CERTIFICATE OF CORRECTION

PATENT NO. : 7,540,483 B2
APPLICATION NO. : 11/322644
DATED : June 2, 2009
INVENTOR(S) : Eung Min Park It is certified that error appears in the above-identified patent and that said Letters Patent is hereby corrected as shown below:

Title page, item

(73) Assignee: should read as follows: ~~LG Electronics Inc.~~ LG N-SYS INC., Seoul (KR)

Signed and Sealed this
First Day of March, 2011

David J. Kappos

David J. Kappos
*Director of the United States Patent and Trademark Office*